United States Patent [19]

Lamson et al.

[11] Patent Number: 4,673,092

[45] Date of Patent: Jun. 16, 1987

[54] MULTI-LEVEL RACK ASSEMBLY

[75] Inventors: Frederick W. Lamson, Birmingham; Richard Lansing, Livonia; Robert Decheim, Fenton; William Martin, Milford, all of Mich.

[73] Assignee: Lockwood Manufacturing Company, Livonia, Mich.

[21] Appl. No.: 782,093

[22] Filed: Sep. 30, 1985

[51] Int. Cl.[4] ..... A47B 47/00

[52] U.S. Cl. ..... 211/188; 211/186; 211/194; 108/53.5; 108/53.1; 248/165

[58] Field of Search ..... 211/188, 194, 186, 189; 108/53.1, 53.5; 248/165; 182/178; 403/49

[56] References Cited

U.S. PATENT DOCUMENTS

| | | | |
|---|---|---|---|
| 3,000,602 | 9/1961 | O'Brien | 108/53.5 |
| 3,140,673 | 7/1964 | Williams | 108/53.5 |
| 3,207,095 | 9/1965 | Hiatt, Jr. | 108/53.5 |
| 3,400,671 | 9/1968 | Erismann | 108/53.5 |
| 3,565,018 | 2/1971 | Jay | 108/53.1 |
| 3,857,494 | 12/1974 | Giardini | 108/53.5 |
| 4,199,069 | 4/1980 | Talarico | 211/194 |
| 4,467,927 | 8/1984 | Nathan | 211/188 |

FOREIGN PATENT DOCUMENTS

| | | | |
|---|---|---|---|
| 1057333 | 10/1953 | France | 211/194 |
| 1406373 | 9/1963 | France | 182/178 |
| 1511101 | 1/1968 | France | 182/178 |
| 777986 | 7/1957 | United Kingdom | 211/194 |
| 994938 | 6/1965 | United Kingdom | 211/194 |
| 996969 | 6/1965 | United Kingdom | 211/188 |
| 1222183 | 2/1971 | United Kingdom | 211/188 |
| 1360683 | 7/1974 | United Kingdom | 108/53.5 |

*Primary Examiner*—Cornelius J. Husar

*Assistant Examiner*—Todd G. Williams

*Attorney, Agent, or Firm*—Krass & Young

[57] ABSTRACT

A multi-level rack assembly comprising a plurality of base members each including a generally rectangular platform portion and an upstanding tubular portion at each corner of the platform portion having a plug dividing the interior thereof into upper and lower tubular volumes; a plurality of side support members each including a pair of spaced upstanding tubular portions and truss means interconnecting the tubular portions; and a plurality of core rod means sized to fit slidably within the tubular portions of the base members and of the side support members. In one embodiment, the core rods are elongated and unitary and have a length somewhat greater than the length of the side support member tubular portions so that the core rods may extend vertically within the side support member tubular portions and seat at their lower ends in the upper tubular volumes of the tubular portions of a lower base member and seat at their upper ends in the lower tubular volumes of the tubular portions of an upper base member. In another embodiment, each of the core rod means comprises a pair of core rod members each including an upper portion sized to fit slideably within the lower end of the tubular portion of an associated side support member or the lower tubular volume of a tubular portion of an upper base member; a lower rod portion sized to fit slideably within the upper end of the tubular portion of the associated side support member or the upper tubular volume of a tubular portion of a lower base member; and a collar portion intermediate the upper and lower rod portions to define the respective seated positions of the upper and lower rod portions.

8 Claims, 6 Drawing Figures

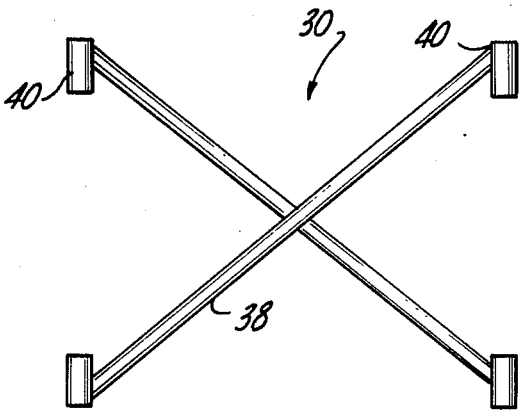
Fig-3
Fig-4
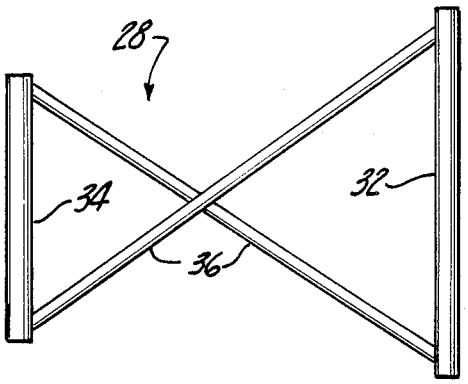
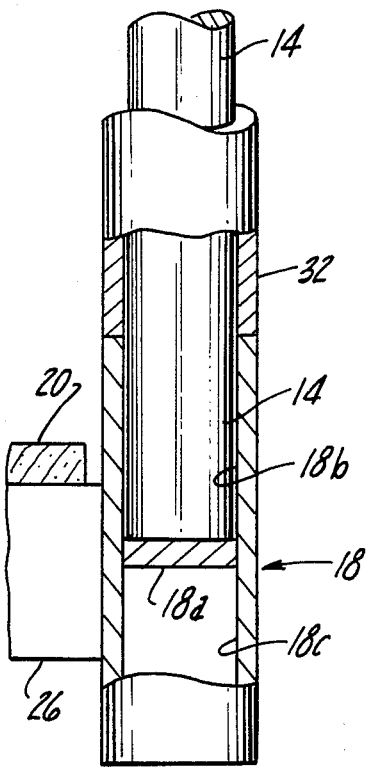
Fig-5
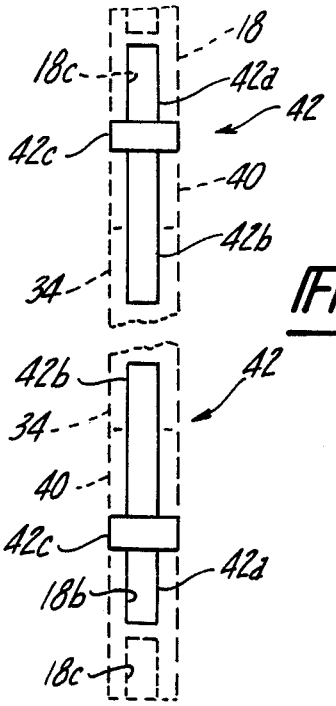
Fig-6

MULTI-LEVEL RACK ASSEMBLY

TECHNICAL FIELD

This invention relates to rack assemblies and more particularly to rack assemblies of the multi-tier or multi-level type.

BACKGROUND ART

A multitude of rack assembly designs have been proposed for storing and/or transporting goods. A commercially feasible rack assembly, especially of the multi-level variety, should be inexpensive to manufacture; should be of sufficient strength to easily handle the anticipated loading; should provide ready and compact storage when not in use; and should provide a stable stacked structure which is extremely resistant to dislodgment.

Each of the various prior art multi-level rack assembly designs have suffered deficiencies in one or more of the above recited areas. Specifically, those rack assemblies that have provided stable and strong storage capacity have tended to be unduly expensive and/or have been difficult to collapse for storage purposes. Coversely, the prior art rack assemblies that have been relatively inexpensive to produce and that have been readily collapsible have not provided sufficient strength and stability in all loading environments.

BRIEF SUMMARY OF THE INVENTION

This invention is directed to the provision of a multi-level rack assembly that is inexpensive to produce, readily collapsible, and extremely strong and stable.

The multi-level rack assembly according to the invention includes a plurality of base members; a plurality of side support members adapted to be upstandingly and removably positioned between a pair of vertically spaced base members and including means defining vertically extending tubes; a plurality of core rods adapted to be slidably positioned within the tubes; and means on the base members adapted to removably receive the core rods and operative to preclude lateral displacement of the base members relative to the core rods and relative to the side support members.

More specifically, the invention multi-level rack assembly includes a plurality of base members each including a generally polygonal platform portion and an upstanding tubular portion at each corner of the platform portion having a plug dividing the interior of the tubular portion into upper and lower volumes; a plurality of side support members each including a pair of laterally spaced upstanding tubular portions and truss means interconnecting the tubular portions; and a plurality of core rods sized to fit slidably within the tubular portions of the base members and of the side support members. With this arrangement, the core rods may be positioned within the side support member tubular portions with lower core rod ends seated in the upper tubular volumes of the tubular portions of a lower base member and with upper core rod ends seated in the lower tubular volumes of the tubular portions of an upper base member. This arrangement provides an extremely sturdy multi-tier structure and yet may be readily knocked down to provide a plurality of generally planar members which can be stacked essentially in laminar fashion to minimize storage requirements.

In one disclosed embodiment of the invention, each core rod means comprises an elongated unitary rod extending through the tubular portion of the associated side support member for receipt at its upper end in the lower tubular volume of the associated tubular portion of an upper base member and at its lower end in the upper tubular volume of the associated tubular portion of a lower base member.

In another disclosed embodiment of the invention, each core rod means comprises a pair of core rod members each including an upper rod portion sized to fit slideably within the lower end of the tubular portion of an associated side support member or the lower tubular volume of a tubular portion of an upper base member, a lower rod portion sized to fit slideably within the upper end of the tubular portion of the associated side support member or the upper tubular volume of a tubular portion of a lower base member, and a collar portion intermediate the upper and lower rod portions to define the respective seated positions of the upper and lower rod portions.

According to a further feature of the invention, the platform portions of the base members are generally rectangular, three side support members are provided for use between each pair of vertically spaced base members; the tubular portions of two of the three side support members are continuous and extend substantially the full height of the side support member with one tubular portion of each pair foreshortened with respect to the other tubular portion of that pair; and each of the tubular portions of the third of the side support members is constituted by a pair of short tubular portions vertically spaced by a distance corresponding to the length of the foreshortened tubular portions of the two side support members and having a cumulative vertical height substantially corresponding to the difference in length between the foreshortened and the full length tubular portions of the two side support members. With this arrangement, the two side support members may be positioned along opposite side edges of the base members with the foreshortened tubular portion of each adjacent the back edge of the base members and the third side support member may be positioned along the back edge of the base members with the short tubular portions thereof positioned above and below the foreshortened tubular portions of the two side support members. This arrangement provides a rigid interlocking mechanism between the side support members and provides extreme rigidity to the multi-tier rack structure without detracting from the ready collapsibility of the rack structure.

According to a further feature of the invention, the truss means for each of the side support members comprises a pair of crossed truss rods extending in X fashion between the laterally spaced pair of tubular portions. This arrangement provides a simple and inexpensive and yet extremely strong structure for the rack assembly.

According to a further feature of the invention, the short vertically spaced tubular portions of the third side support member are respectively secured to the four ends of the X cross rods of that member to provide a simple, inexpensive and yet readily storable structure.

BRIEF DESCRIPTION OF THE DRAWINGS

FIGS. 3 and 4 are side elevational views of side support members used in the invention rack assembly;

FIG. 5 is a detail view within the circle 5 of FIG. 2; and

FIG. 6 is a detail view of an alternate embodiment of the invention.

DETAILED DESCRIPTION OF THE PREFERRED EMBODIMENTS

Figure 1:
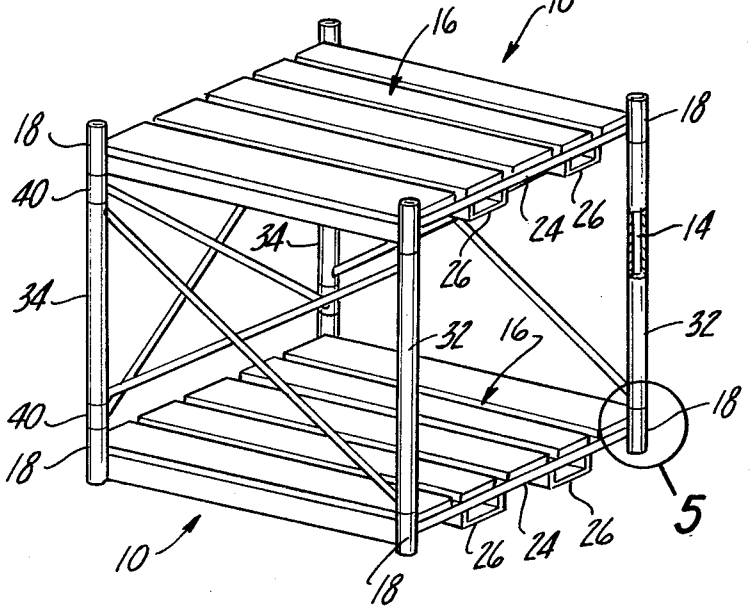
FIG. 1 is a view of the invention rack assembly in an exploded configuration.

The invention rack assembly, broadly considered, comprises a plurality of base members 10; a plurality of side support members 12; and a plurality of elongated, unitary core rods 14.

Each base member 10 includes a rectangular platform portion 16 and an upstanding tubular portion 18 at each corner of the platform portion. Platform portion 16 may comprise a pallet including planks 20, frame members 22 and 24, and channel members 26 secured to the underside of the pallet for receipt of the forks of a forklift truck. Planks 20 are formed of wood. Tubular portions 18, frame members 22 and 24, and channel forklift members 26 are formed of a suitable metallic material and are suitably welded together to form, together with attached planks 20, a rigid unitary structure. Tubular portions 18 extend upwardly above and downwardly below the platform portion 16 and include a central partition or plug 18*a* vertically and centrally dividing the interior of the tubular portion into an upper tubular volume 18*b* and a lower tubular volume 18*c*. Tubular portions 18 extend upwardly to a level above the top surface of planks 20 and extend downwardly to approximately the level of the lower surface of channel forklift members 26 so that the bottom base member is firmly supported on the support surface by the large area interface between the lower surfaces of channel members 26 and the support surface rather than by the relatively small area interface between the lower ends of tubular portions 18 and the support surface. This arrangement has the effect of spreading the load of the invention rack assembly over a large area so as to avoid sinking of the rack assembly into soft support surfaces.

Side support members 12 are of two configurations. Specifically, three side support members 12 are provided for use between each pair of vertically spaced base members 10. Two of these side support members, intended for use at the lateral sides of the rack structure, are of the type seen at 28 in FIG. 4 and the third side support member, intended for use at the back side of the rack, is of the type seen at 30 in FIG. 3.

Lateral side support members 28 each include a vertical front tubular portion 32, a vertical back tubular portion 34, and a pair of crossed truss rods 36 extending in X fashion between tubular portions 34 and 32 to provide a trussed support therebetween. Members 32, 34 and 36 are formed of a suitable metallic material and are welded at their various points of intersection to form a rigid unitary structure. Front tubular portion 32 extends the full height of the side support member whereas back tubular portion 34 is symmetrically foreshortened with respect to front tubular portion 32.

Back side support member 30 includes a pair of crossed truss rods 38 extending in X fashion and a short vertical tubular portion 40 secured to each end of the X truss structure. Each pair of tubular portions 40 is vertically spaced by a distance corresponding to the length of foreshortened tubular portions 34 of lateral side support members 28 and have a cumulative vertical height substantially corresponding to the difference in length between a foreshortened tubular portion 34 and a full length tubular portion 32. Tubular portions 40 and truss rods 38 are formed of a suitable metallic material and are welded together at their various intersections to form a rigid unitary structure.

Tubular portions 18 of base member 10, tubular portions 32 and 34 of lateral side support members 28, and tubular portions 40 of back side support member 30 have the same interior diameter.

Core rods 14 are formed of a suitable metallic material and are sized to fit slidably within the tubular portions 18, 32, 34, and 40. Core rods 14 have a length that is greater than the length of full length tubular portions 32 by an amount that is substantially equal to twice the length of tubular volumes 18*b* and 18*c*.

Alternatively, as seen in FIG. 6, each elongated unitary core rod 14 is replaced by a pair of relatively short core rod members 42. Each core rod member 42 includes a short rod portion 42*a* having a length generally corresponding to the depth or length of tubular volumes 18*b* and 18*c* of tubular portions 18; a long rod portion 42*b* having a length approximately twice the length of tubular portions 40; and a central collar or stop portion 42*c*.

In the assembled relation of the various components of the multi-level rack assembly of the invention, a pair of lateral side support members 28 is positioned between the vertically spaced base members along the respective opposite lateral sides of the pallet portions of the base members, the back side support member 30 is positioned along the back side of the pallet portions with short tubular portions 40 positioned at the upper and lower ends of the foreshortened tubular portions 34 of the lateral side support members 28; and core rods 14 extend within the aligned tubular interiors of tubular portions 32, 34 and 40 with the upper ends of the rods seated in the lower tubular volumes 18*c* of the tubular portions 18 of the upper base member and the lower ends of the rods seated in the upper tubular volumes 18*b* of the tubular portions 18 of the lower base member.

Alternatively, when employing the core rod means of FIG. 6, the short portion 42*a* of a core rod 42 is seated in the upper volume 18*b* of each tubular portion 18 of the lower base member with the long portion 42*b* of the core rod extending upwardly into a tubular portion 32 or upwardly through a tubular portion 40 and into a tubular portion 34, and the short portion of a core rod 42 is positioned in the lower volume 18*c* of each tubular portion of the upper base member with the long portion 42*b* extending downwardly into a tubular portion 32 or downwardly through a tubular portion 40 and into a tubular portion 34. In assembled relation, the collar or stop portions 42*c* define the seated positions of portions 42*a* and 42*b* within the respective associated tubular portion and provide a spacer between the associated tubular portions which may be selectively varied in axial length to selectively vary the overall distance between base members.

Figure 2:
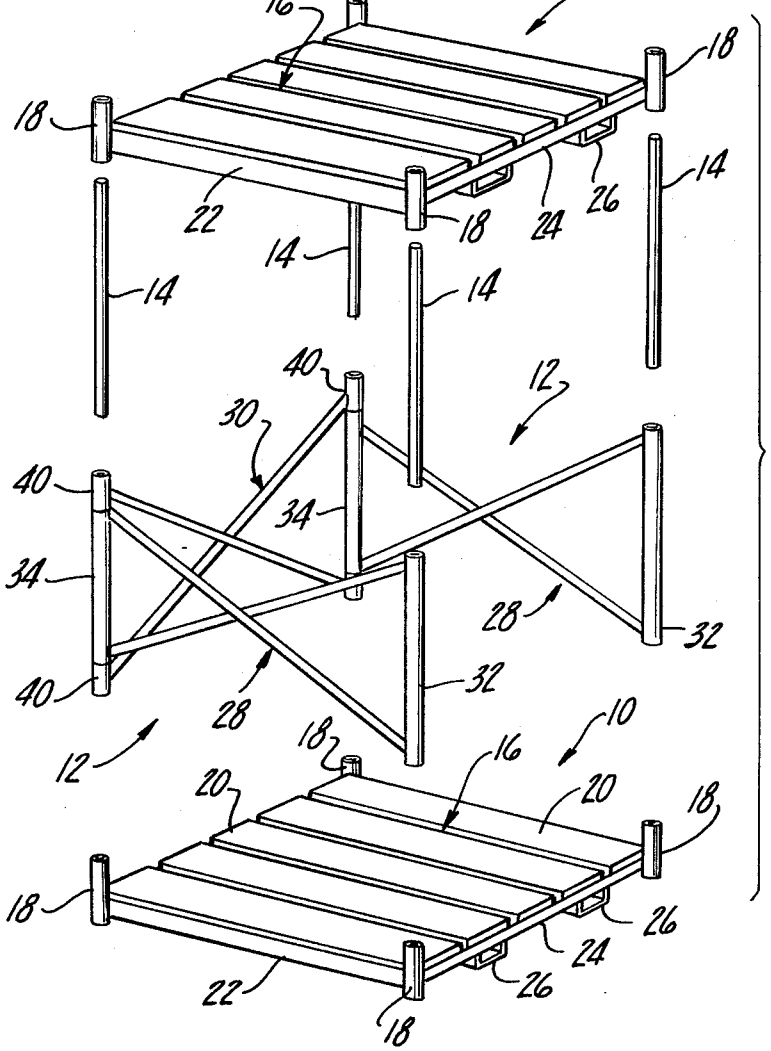
FIG. 2 is a view of the invention rack assembly in an assembled configuration.

The described rack assembly construction provides a multi-level rack that is extremely rigid, extremely strong, and extremely stable and yet which is relatively lightweight and relatively inexpensive to produce. Additional levels may be provided for the rack assembly by providing additional side support members, additional core rod means and an additional base member. When forming a three tier rack assembly, it is preferable to assemble a two tier assembly as seen in FIG. 2, lift the assembled two tier structure with a forklift truck, and build a third tier at ground level beneath the elevated two tier assembly.

The invention rack assembly, in addition to providing a rigid, strong and stable rack assembly structure, is also very quickly assembled and disassembled and readily stored in a a very compact manner. When disassembled, the various elements or members of the rack assembly have a generally planar configuration and may therefore be stored in a stacked configuration with each member comprising a layer in the stack and with the total height of the stack occupying a minimum of storage area. In use, skids containing goods to be stored may be placed on the individual base members 10 and selectively removed by the use of a forklift truck, or the goods stored on a plurality of levels of the rack assembly, either directly on the base members or on skids placed on the base members, may be removed and transported by insertion of the forks of a forklift truck in the tubular members 26 of the bottom most base member of the portion of the rack assembly that it is desired to transport. The invention arrangement provides firm interconnection between the various levels of the rack assembly by virtue of the receipt of rods 14 in the tubular volumes of the tubular members 18 but yet allows the individual tiers of the assembly to be separated simply by lifting of the upper tier relative to the lower tier.

Whereas a preferred embodiment of the invention has been illustrated and described in detail, it will be apparent that various changes may be made in the disclosed embodiment without department from the scope or spirit of the invention.

We claim:

1. A multi-level rack assembly comprising:

(A) upper and lower base members each including a polygonal platform portion and an upstanding tubular portion at each corner of the platform portion;

(B) a plurality of side support members upstandingly and removably positioned between said upper and lower base members and each comprising a pair of vertically extending and laterally spaced tube means and truss means interconnecting the spaced tube means, each of said tube means having an inner diameter corresponding to an inner diameter of said base member tubular portion, extending between said upper and lower base members and axially aligned with respective tubular portions of said upper and lower base members, an upper end of at least one of said vertically extending tube means of said side support members abuttingly engaging a tubular portion of the upper platform member and a lower end of said at least one of said vertically extending tube means abuttingly engaging the corresponding tubular portion of the lower tubular member so that said at least one tube means transfers the loading imposed on said upper base member to said lower base member;

(C) an elongated locating and aligning core rod respectively slidably received within each of said tube means, each of said core rods having a constant diameter throughout its length less than said inner diameter of said base member tubular portions and of said tube means and having a length exceeding the length of the respective tube means so that each rod projects out of the upper and lower ends of the respective tube means for slidable locating receipt of the projecting upper end in the corresponding tubular portion of the upper base member and for slidable locating receipt of the projecting lower end in the corresponding tubular portion of the lower base member; and (D) means preventing movement of said projecting lower ends of said core rods downwardly through said tubular portions of said lower base member whereby said rods locate said side members relative to said base members to facilitate assembly of the rack assembly, interconnect said base members and said side support members in the assembled condition of said rack assembly, and prevent relative lateral movement of said base members and said side support members by providing a continuous structural member extending through said tube means and into said upper and lower base members.

2. A multi-level rack assembly according to claim 1 wherein:

(E) said rack assembly further includes means for preventing movement of said projecting upper ends of said core rods upwardly through said tubular portions of said upper base member; and (F) said preventing means comprises an interior plug dividing the interior of the respective tubular portion into upper and lower volumes for respective removable receipt of a projecting lower end of one core rod or the projecting upper end of another core rod, each of said upper and lower volumes having a constant diameter cylindrical configuration for smooth, telescopic receipt of said core rods.

3. A multi-level rack assembly according to claim 2 wherein:

(G) the platform portion of each base member is rectangular.

4. A multi-level rack assembly comprising:

(A) upper and lower base members each including a generally polygonal platform portion and an upstanding tubular portion at each corner of said platform portion having a plug dividing the interior volume thereof into upper and lower tubular volumes, each of said upper and lower volumes having a constant diameter cylindrical configuration;

(B) a plurality of side support members each including a pair of laterally spaced upstanding load supporting tubular means and truss means interconnecting said tubular means, said side support member tubular means each having an inner diameter corresponding to a diameter of said upper and lower volumes of said base member tubular portions, said side support members positioned vertically between said upper and lower base members with their tubular portions vertically aligned with respective tubular portions of said upper and lower base members, at least one of said tubular means of each of said side support members having an upper end and a lower end respectively abuttingly engaging the aligned tubular portions of said upper and lower base members so that said at least one tubular means transmits the loading imposed on said upper base member to said lower base member; and (C) a plurality of elongated core rods respectively slidably received within the tubular portions of said base members and the tubular means of said side support members, each of said core rods having a constant diameter throughout its length less than the constant diameter of said upper and lower volumes of said base member tubular portions and of said side support member tubular means and having a length exceeding the length of the respective side support member tubular means so that each rod projects out of the upper and lower ends of the respective side support member tubular means for slidable locating receipt of the projecting upper end in a lower tubular volume of a tubular portion of said upper base member and for slidable locating receipt of the projecting lower end in an upper tubular volume of a tubular portion of said lower base member, said core rods locating said side support members relative to said base members to facilitate assembly of the rack assembly, interconnecting said base members and side support members in the assembled condition of said rack assembly, and preventing relative lateral movement between said base members and said side support members by providing a continuous structural member extending through said tubular means of said side support member and into said upper and lower base members.

5. A rack assembly according to claim 4 wherein:

(D) said truss means for each side support member comprises a pair of crossed truss rods extending in X fashion between said laterally spaced pair of tubular means.

6. A rack assembly according to claim 5 wherein:

(E) three side support rack members are provided for use betweeen each pair of vertically spaced base members;

(F) the tubular means of two of said three side support members are continuous and extend substantially the full height of the side support members; and (G) each of the tubular means of the third of said side support members is constituted by a pair of short vertically spaced tubular portions with each short tubular portion respectively secured to an end of a cross rod of said third side support member.

7. A multi-level rack assembly comprising:

(A) a plurality of base members each including a generally rectangular platform portion and an upstanding tubular portion at each corner of said platform portion having a plug dividing the interior thereof into upper and lower volumes;

(B) three side support members for use between each pair of vertically spaced base members and each including a pair of laterally spaced upstanding tubular means and truss means interconnecting said tubular means, the tubular means of two of said three side support members comprising a first continuous tubular portion extending substantially the full height of the side support member and a second tubular portion foreshortened with respect to said first tubular portion of that member, each tubular means of the third of said side support members comprising a pair of short tubular portions vertically spaced by a distance generally corresponding to the length of said second tubular portions of said two side support members and having a cumulative vertical height substantially corresponding to the difference in length between said second and said first tubular portions of said two side support members so that said two side support members may be positioned along opposite lateral side edges of said base members with the second tubular portion of each adjacent the back side edge of said base members, and said third side support member may be positioned along said back side edge of said base members with said short tubular portions thereof positioned above and below a respective second tubular portion; and (C) a plurality of core rod means sized to fit slidably within the tubular portions of said base member and of said side support members.

8. A rack assembly according to claim 7 wherein:

(D) said truss means for each side support member comprises a pair of cross truss rods extending in an X fashion between the laterally spaced pair of tubular means of the respective side support members with each short tubular portion of said third side support member respectively secured to an end of a cross rod of said third side support member.

* * * * *